US012310441B2

(12) United States Patent
Yates et al.

(10) Patent No.: US 12,310,441 B2
(45) Date of Patent: May 27, 2025

(54) AUGMENTED GEAR FOR EXERCISE, THERAPY AND DAILY USE

(71) Applicant: Gravity UPgear LLC, Nashville, TN (US)

(72) Inventors: Brent Yates, Nashville, TN (US); Alberto G Fuentes, Nashville, TN (US)

(73) Assignee: Gravity UpGear, LLC, Nashville, TN (US)

( * ) Notice: Subject to any disclaimer, the term of this patent is extended or adjusted under 35 U.S.C. 154(b) by 0 days.

(21) Appl. No.: 18/516,612

(22) Filed: Nov. 21, 2023

(65) Prior Publication Data

US 2024/0277090 A1 Aug. 22, 2024

Related U.S. Application Data

(60) Provisional application No. 63/486,220, filed on Feb. 21, 2023.

(51) Int. Cl.
*A63B 21/065* (2006.01)
*A41D 31/18* (2019.01)

(52) U.S. Cl.
CPC ..... *A41D 31/185* (2019.02); *A41D 2400/10* (2013.01); *A41D 2400/38* (2013.01)

(58) Field of Classification Search
CPC ..... A41D 2400/10; A41D 2400/38; A41D 31/185; A63B 21/065
See application file for complete search history.

(56) References Cited

U.S. PATENT DOCUMENTS 4,268,917 A * 5/1981 Massey ..... A63B 21/065 2/102
4,602,387 A * 7/1986 Zakrzewski ..... A63B 21/065 2/2.5
4,658,442 A * 4/1987 Tomlinson ..... A63B 21/065 2/2.5
5,810,699 A * 9/1998 Nadeau ..... A63B 21/065 2/102
5,937,441 A * 8/1999 Raines ..... A63B 21/065 2/69
6,081,924 A * 7/2000 Ott ..... A63B 21/065 2/102
6,209,135 B1 4/2001 Irvin
(Continued)

FOREIGN PATENT DOCUMENTS

EP 2842611 A1 3/2015

OTHER PUBLICATIONS

International Patent Application No. PCT/US2024/016503; Int'l Search Report and the Written Opinion; dated May 14, 2024; 12 pages.

(Continued)

*Primary Examiner* — Tajash D Patel
(74) *Attorney, Agent, or Firm* — BakerHostetler

(57) ABSTRACT

Augmented gear for a user comprises a plurality of weights integrated into the augmented gear, wherein said plurality of weights are a selected fraction of the user's body weight. An insulating material traps the user's body heat under the augmented gear. The augmented gear is also configured to compress against the user's body in three dimensions. The combination of weight, insulation, and compression provides the user with synergistic performance.

20 Claims, 10 Drawing Sheets

(56) References Cited

U.S. PATENT DOCUMENTS

| | | | | |
|---|---|---|---|---|
| 6,286,146 | B1 * | 9/2001 | Rocker | A63B 21/4001 2/102 |
| 6,665,879 | B2 * | 12/2003 | VandenBerg | A63B 21/065 2/102 |
| 6,748,601 | B2 * | 6/2004 | LaShoto | A63B 71/1225 2/102 |
| 7,490,361 | B1 | 2/2009 | Floyd | |
| 7,770,234 | B2 * | 8/2010 | Roux | A41D 3/00 2/69 |
| D734,922 | S | 7/2015 | Docker | |
| 11,849,777 | B2 * | 12/2023 | Kuhner-Stout | A61H 7/002 |
| 2009/0139005 | A1 | 6/2009 | Whaley | |
| 2011/0167533 | A1 | 7/2011 | Stewart | |
| 2012/0089058 | A1 * | 4/2012 | Ellis | A41D 1/08 601/134 |
| 2016/0287924 | A1 | 10/2016 | Robinson et al. | |
| 2017/0304670 | A1 | 10/2017 | Herron | |
| 2022/0110822 | A1 * | 4/2022 | Cooper | A41D 1/04 |

OTHER PUBLICATIONS

Nike-SPARQ Training (Speed, Power, Agility, Reaction, Quickness); https://www.facebook.com/watch/?v=1625206370890479; facebook; accessed Dec. 5, 2023; 2 pages.

https://www.omorpho.com/vests/; OMORPHO; © 2023; accessed Dec. 5, 2023; 3 pages.

"Hyper Vest Elite Weight Vest"; https://hyperwear.com/products/hyper-elite; Hyper Wear Inc.; © 2023; accessed Dec. 12, 2023; 10 pages.

* cited by examiner

AUGMENTED GEAR FOR EXERCISE, THERAPY AND DAILY USE

CROSS-REFERENCE TO RELATED APPLICATION

This application claims the benefit of and priority to U.S. Provisional Patent Application No. 63/486,220, titled Weighted Exercise Vest, filed on Feb. 21, 2023, the entirety of which is incorporated herein by reference.

TECHNICAL FIELD

The subject matter disclosed generally relates to exercise and therapy apparatuses, and more particularly relates to garments incorporating various stimuli to enhance performance and results.

BACKGROUND

Apparel or gear to augment exercise, training, and therapy are available in all shapes and sizes. Many of these products are focused on a singular concern and provide limited utility. For example, traditional weight vests are used to increase resistance, and do so, but have a variety of ergonomic drawbacks including concentrating the persistent load bearing of the vest on the shoulders or other small muscle groups and limiting mobility. Moreover, weight vests are typically constructed solely for the purpose of bearing the load to be worn and worn atop the user's clothing, and can be uncomfortable and limit the user's ability to utilize and receive the benefits of other training or therapeutic apparatuses.

SUMMARY

What is presented is augmented gear for a user that comprises a plurality of weights integrated into the augmented gear. The weights may be a selected fraction of the user's body weight. An insulating material may be included that is configured to trap the user's body heat under the augmented gear. The augmented gear may be configured to compress against the user's body in three dimensions. The combination of weight, insulation, and compression may provide the user with synergistic performance improvements.

In some embodiments, the plurality of weights in the augmented gear may be between about 2% and about 6% of the user's body weight. In some embodiments, the augmented gear may have a front face and a back face that respectively correspond to the front and back of a user, and the plurality of weights may be distributed approximately equally between the front face and the back face. In some embodiments, the plurality of weights may be distributed approximately equally around the augmented gear. In some embodiments, the plurality of weights may be distributed to not interfere with natural expansion and contraction of the user's muscle groups during use. In some embodiments, the plurality of may be distributed on the front face and the back face. In some embodiments, the plurality of weights distributed on the front face may be favored towards the user's abdomen. In some embodiments, the plurality of weights distributed on the back face may be equally distributed around the back face. In some embodiments, the plurality of weights may be distributed complementary to the user's muscle groups.

The plurality of weights located on the user's body and the compression of the augmented gear adjusted for the user's body may be configured to activate the user's musculature and adjust the user's posture when the augmented gear is in use. In some embodiments, a stretchable material may be included that is configured to cause the augmented gear to compress against the user's body. In some embodiments, the plurality of weights may be configured to cause the augmented gear to compress against the user's body.

In variations of the augmented gear, the plurality of weights may be constructed from a material selected from the group consisting of metal, plastics, silicone, resins, and a combination thereof. In some embodiments, the plurality of weights may be installed in the augmented gear in a foam or silicone matrix.

In some embodiments, nodules may be integrated into the augmented gear and configured to apply pressure to corresponding muscular release points on the user's body.

In some embodiments, the augmented gear may be configured to be worn over or under a user's clothing. In some embodiments, the augmented gear may have sleeves or may be sleeveless. Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention. This Summary is intended to describe only certain aspects of the disclosure and should not be interpreted as in any way limiting the disclosure or scope or spirit of the inventions disclosed herein.

BRIEF DESCRIPTION OF THE DRAWINGS

For a more complete understanding and appreciation of this invention, and its many advantages, reference will be made to the following detailed description taken in conjunction with the accompanying drawings.

Figure 1:
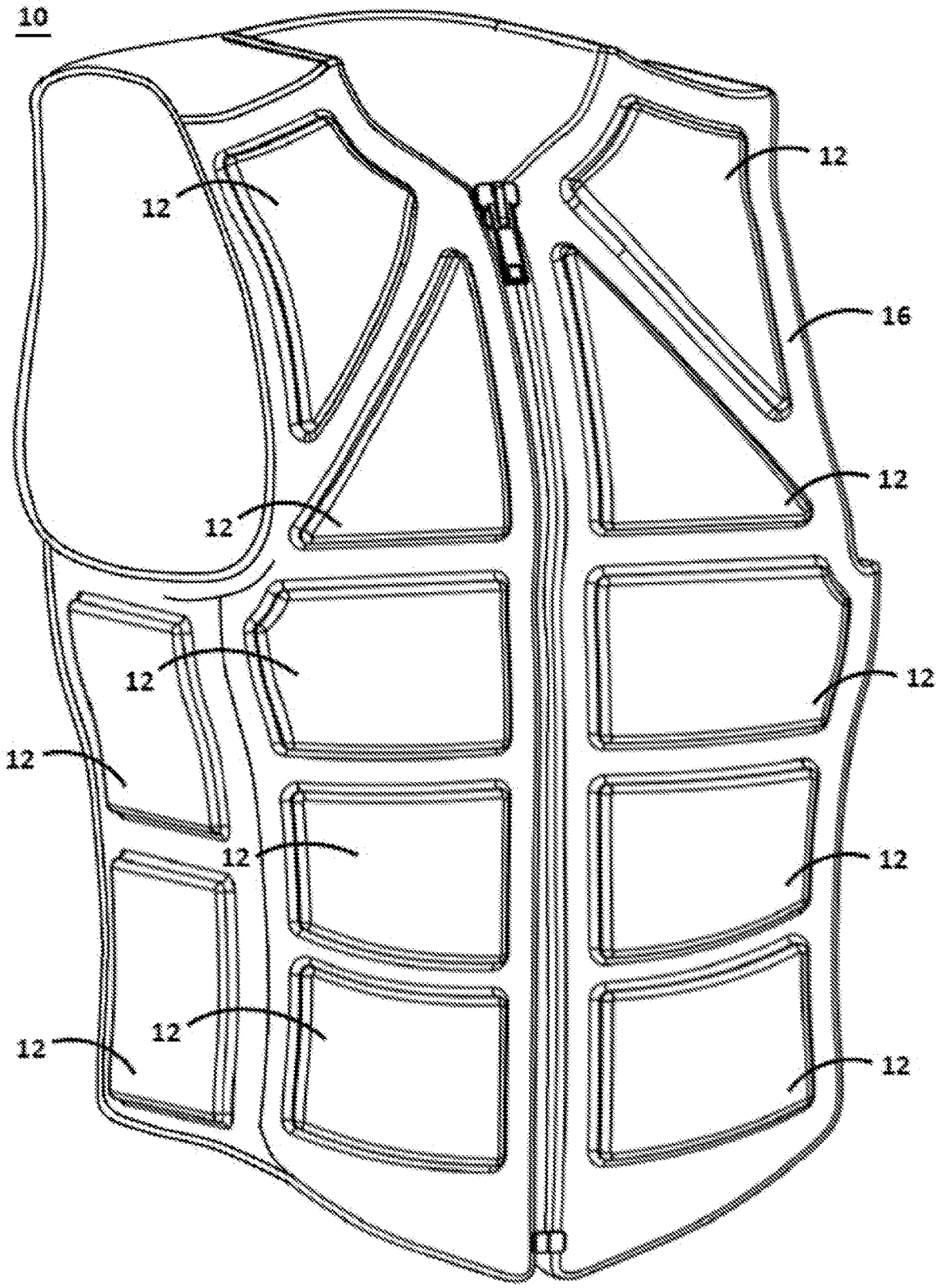
FIG. 1 is a perspective view of an embodiment of augmented gear that is a vest.

This Brief Description of the Drawings is intended to describe only certain aspects of the disclosure and should not be interpreted as in any way limiting the disclosure or scope or spirit of the inventions disclosed herein.

DETAILED DESCRIPTION

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

As used herein, "augmented gear" refers to garments worn on a portion of a user's body incorporating one or more of weighting, compression, and/or heat insulation. Further, a "garment" as referred herein can include, e.g., a vest, a shirt, a jacket, leggings, pants, a sleeve, a brace, leg warmers, footwear, and gloves. Those of skill in the art will appreciate that additional alternative or complementary garments or wearable gear can incorporate aspects of the disclosures herein without departing from the scope or spirit of the innovation.

Figure 2:
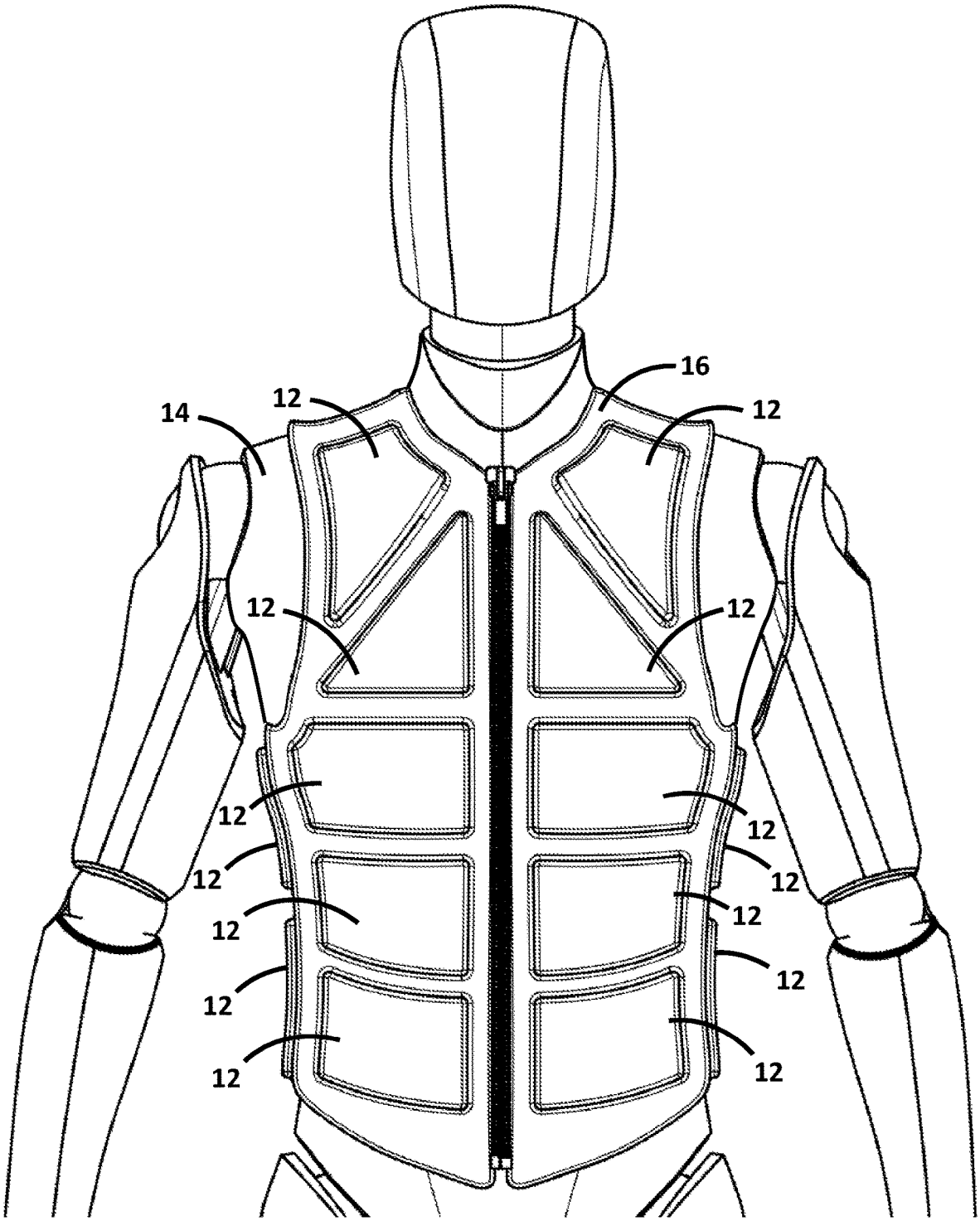
FIG. 2 is a front view of the augmented gear of FIG. 1 shown worn by a user.
Figure 3:
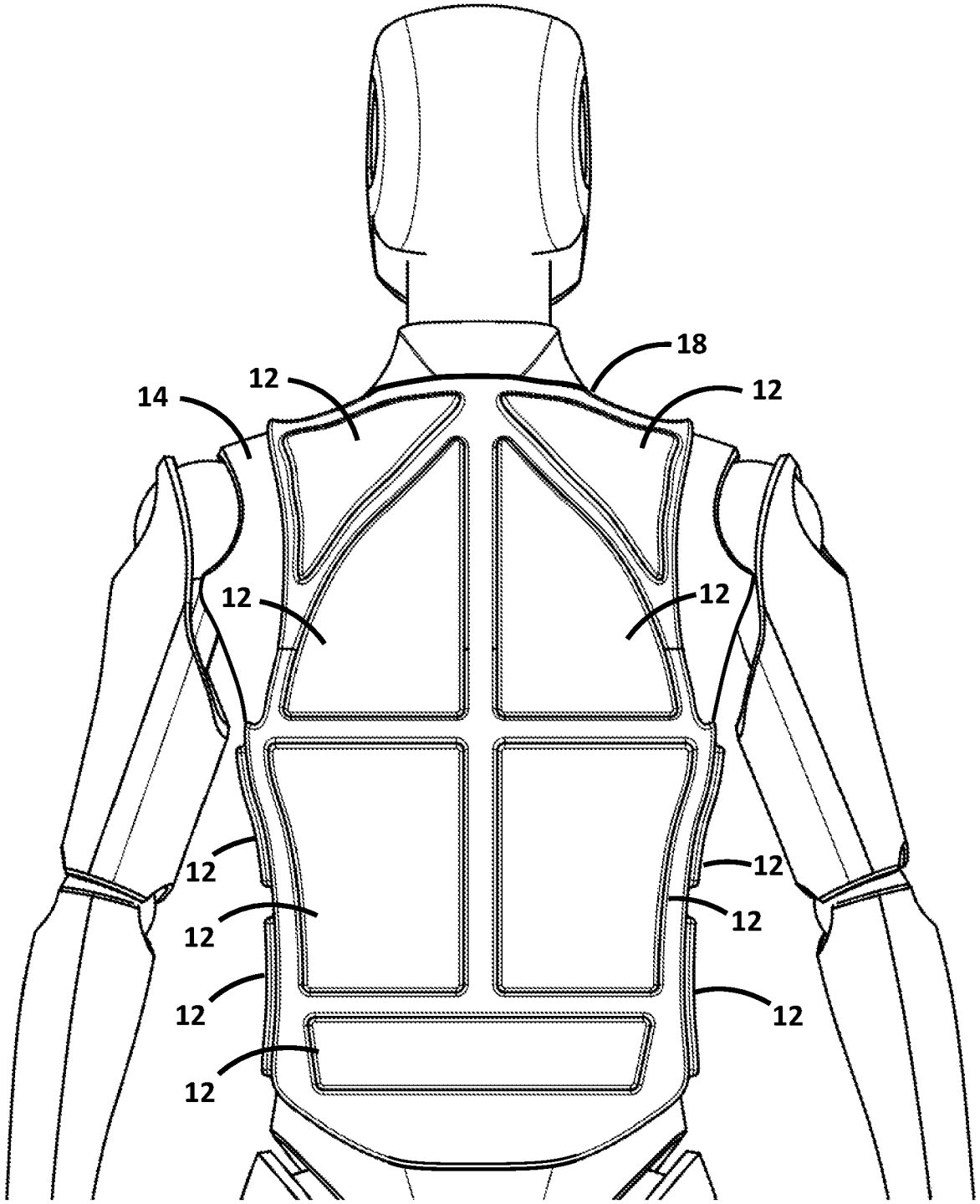
FIG. 3 is a rear view of the augmented gear of FIG. 1 shown worn by a user.
Figure 4:
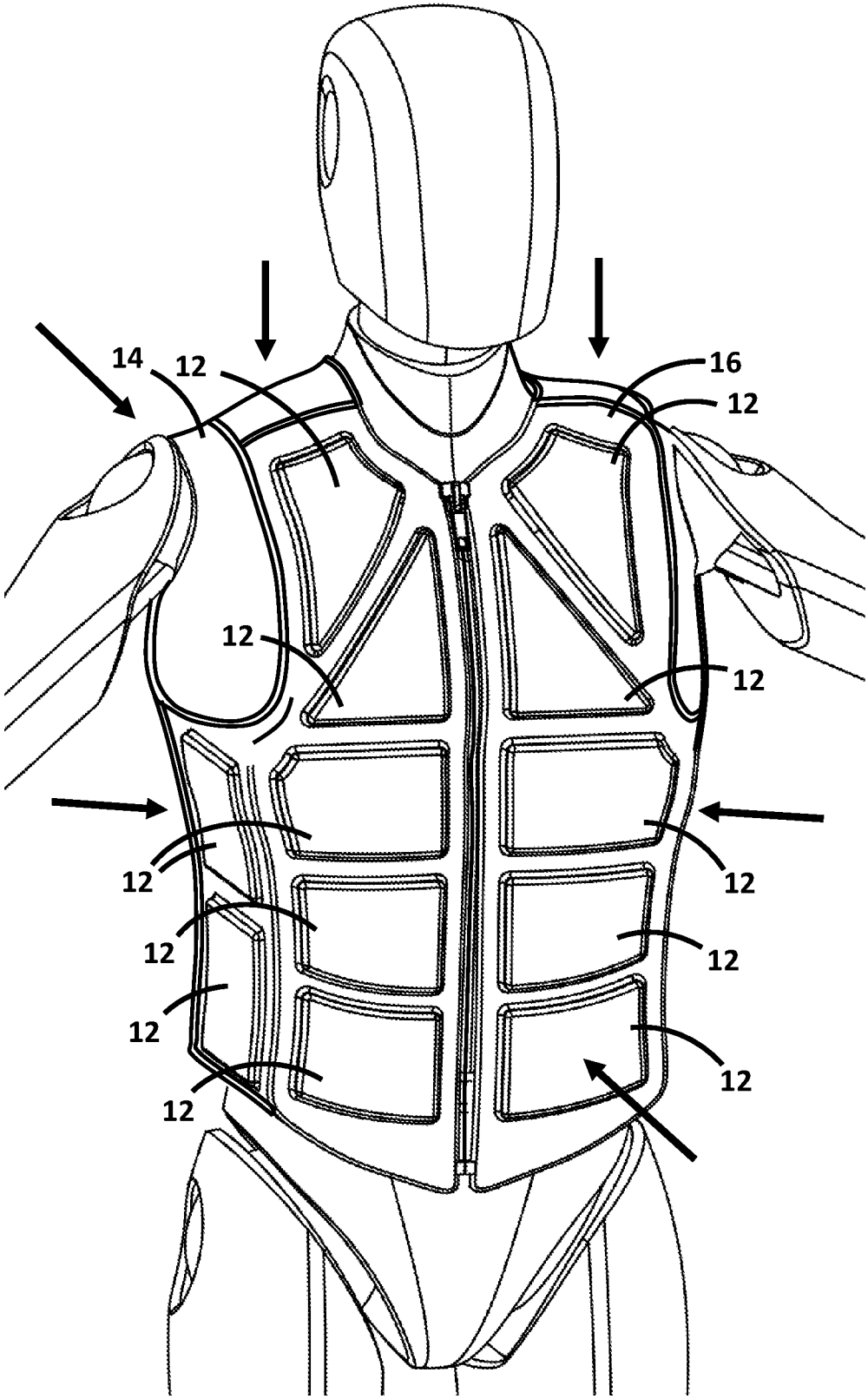
FIG. 4 is a perspective view showing how the augmented gear of FIG. 1 compresses against a user in three dimensions.

As shown in FIGS. 1-3, what is presented is augmented gear 10 that is an example garment (a vest) for a user that comprises weights 12 integrated into the augmented gear. The weights 12 are a selected fraction of the user's body weight. The augmented gear 10 comprises a garment that can include insulated material to trap the user's body heat under the augmented gear 10. As shown in FIG. 4, the augmented gear 10 can also include material to compress against the user's body 14 in up to three dimensions (indicated by the arrows in FIG. 4)—from the front and back, from the sides, and/or downwards from the shoulders. As illustrated, the augmented gear 10 may define a longitudinal line of symmetry such that a left-side portion of augmented gear 10 includes weights 12 of common number, size, and/or positioning as a right-side portion of augmented gear 10, although other arrangements are possible. The number, size, and/or position of the weights 12 can be selected as desired to suit a particular application. By way of non-limiting example, the augmented gear 10 illustrated in FIGS. 1-3 includes 21 total weights 12 distributed between two right-side panel weights 12, two left-side panel weights 12, ten weights 12 on the front face 16, and seven weights 12 on the back face 18, although other numbers are possible.

Figure 5B:
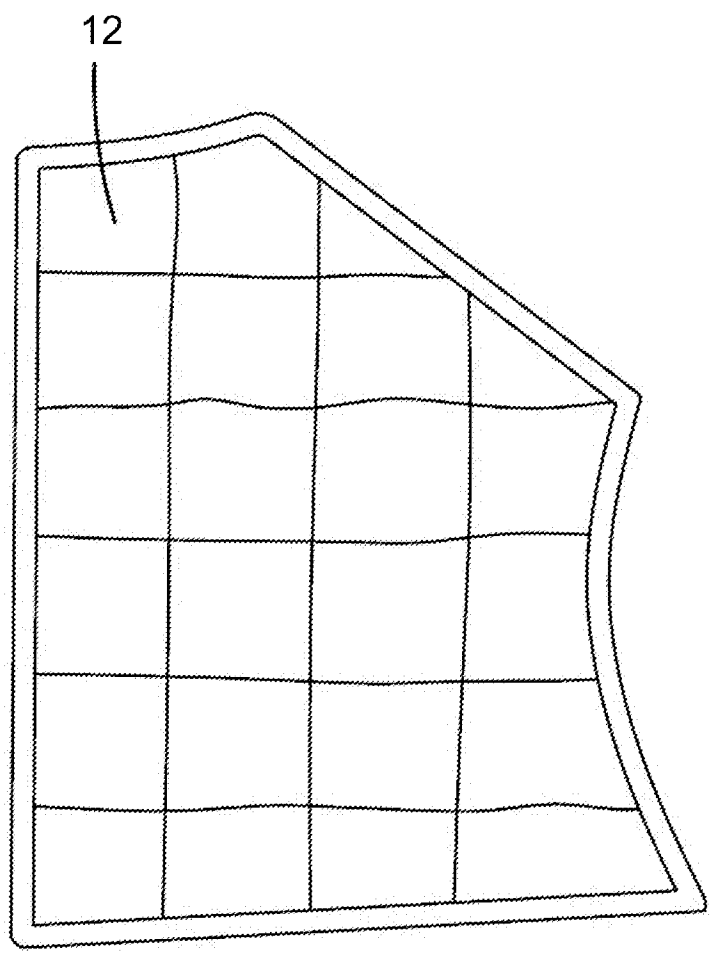
FIG. 5B illustrates another view of the example arrangement of weights depicted in FIG. 5A.
Figure 5A:
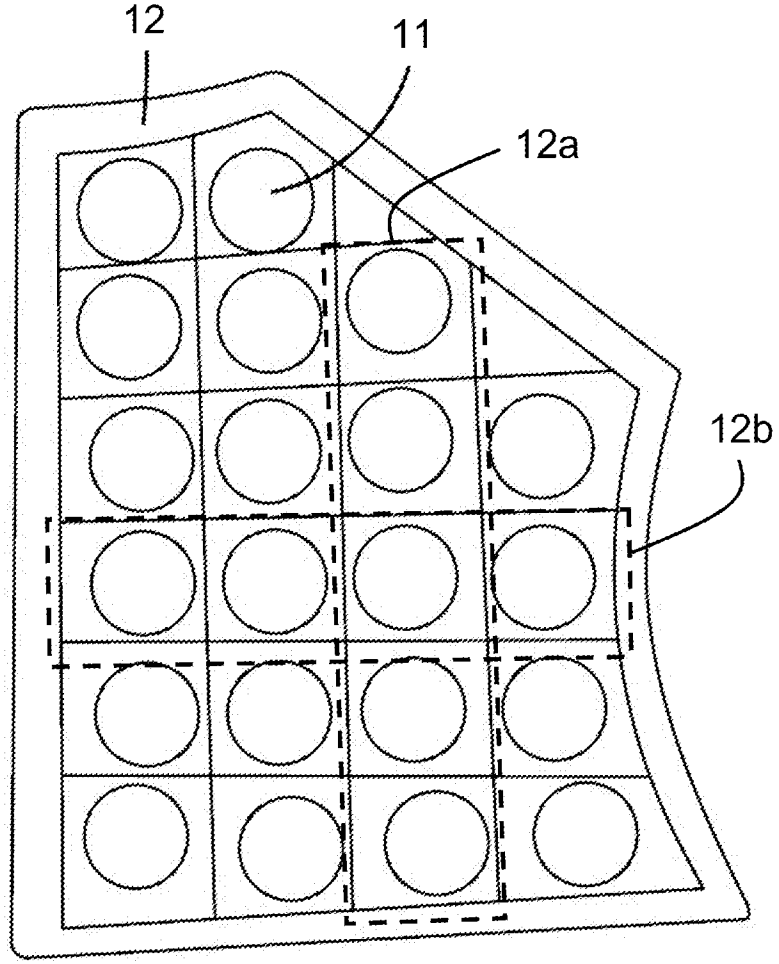
FIG. 5A illustrates an example arrangement of weights in a portion of augmented gear that is a vest disclosed herein.
Figure 6B:
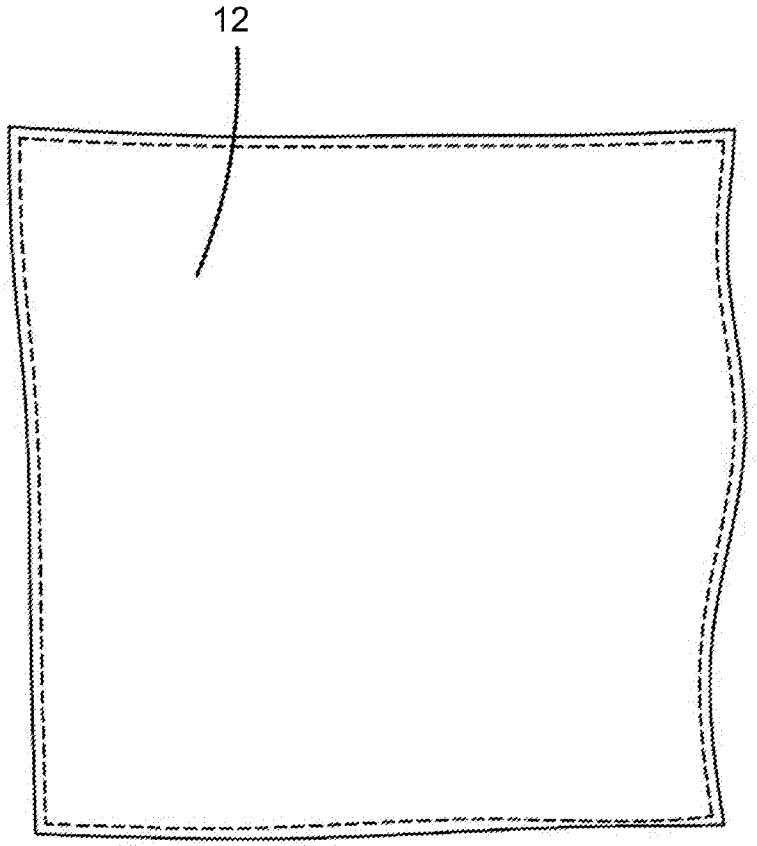
FIG. 6B illustrates another view of the example arrangement of weights depicted in FIG. 6A.
Figure 6A:
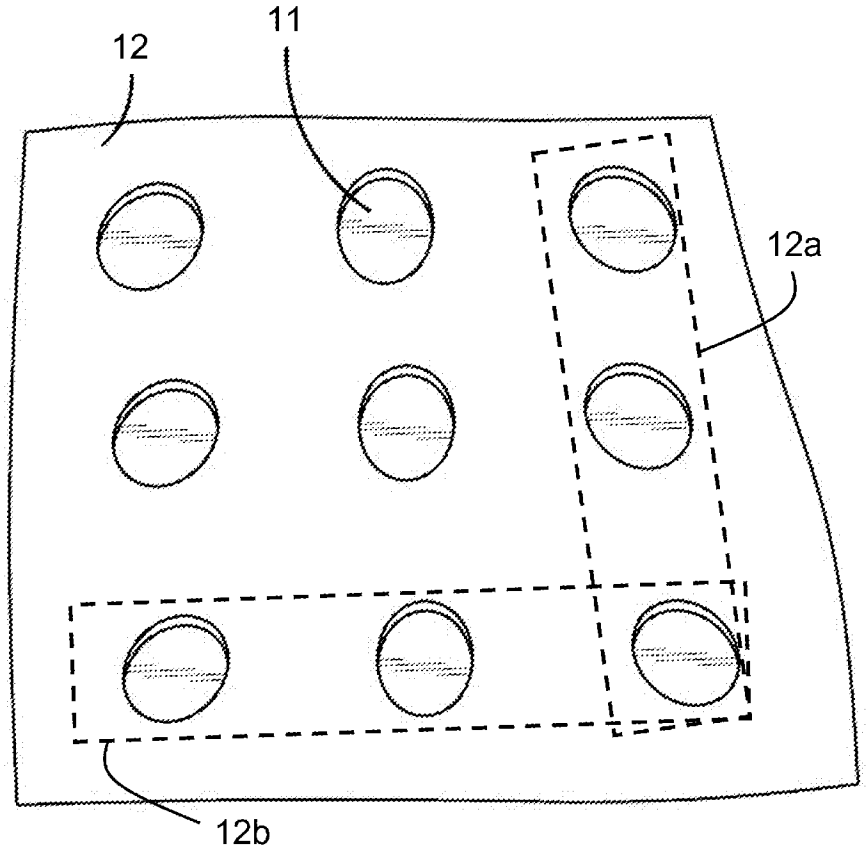
FIG. 6A illustrates an example arrangement of weights in a portion of augmented gear that is a vest disclosed herein.

In embodiments, the weights 12 may be arranged in one or more columns 12*a* extending along a length of the augmented gear 10 (one of which is labeled in FIG. 5A and FIG. 6A for clarity) and/or one or more rows 12*b* extending along a width of the augmented gear 10 (one of which is labeled in FIG. 5A and FIG. 6A for clarity). By way of non-limiting example, for the augmented gear 10 illustrated in FIGS. 1-3, the front face 16 includes two columns 12*a* each including five weights 12 and five rows 12*b* each including two weights 12, although other arrangements are possible.

In embodiments, the structure of a garment forming augmented gear 10 can be comprised of one or more materials. These can include, but are not limited to, neoprene, nylon, polyester, Kevlar, cotton, spandex, velour, suede, satin, elastane, foam, adhesives, stitches, thread, tapes, elastics, et cetera, including combinations thereof. Other options will be understood by those of skill in the art on review of the disclosures herein. For garments that open and close, such as vests or jackets, various closures can be used including, e.g., zippers, hook-and-loop, buttons, clasps, laces, hook-and-eye closures, buckles, magnets, et cetera, including combinations thereof. To aid in durability and performance, such closures can be heavy-duty; for example, marine zippers can be utilized to resist wear or failure due to moisture and motion. In embodiments, top or bottom zipper garages can be built into the structure of a garment to protect the zipper slider as well as improving comfort and appearance. In embodiments, flatlock stitching can be used to assemble different portions of a garment or garment shell for strength and to avoid bulk at edges.

In embodiments, multiple specifications of the same material can be utilized in the same augmented gear 10. In a non-limited example, a vest can include 2 mm thick neoprene about first portions of a front and back bodice, and 1 mm thick neoprene about other portions of a front and back bodice as well as side panels.

In embodiments, antimicrobial materials or agents can be applied to one or more of the materials. In embodiments, hydrophilic or hydrophobic materials or treatments can be used in or on various portions of a garment of augmented gear 10.

Assembly of the materials can be made so as to properly support the weights 12 incorporated into augmented gear 10 while benefitting user comfort and ergonomics. For example, an interior lining of a vest as depicted may, directly or indirectly, bear at least a portion of the load of weights 12. As such, the lining can be anchored below the collar of the vest to allow for a long seam running the width of the vest to share the load. By anchoring below the collar, the load is not concentrated on a user's neck or interior and/or top of their shoulders, instead spreading the load across the body (including but not limited to all sides of the shoulders, back, chest, et cetera). Such a lining can also be anchored at the armholes and bottom hem for further support and stability.

Such a vest garment can also include side panels to deliberately accommodate the depth of the user in a manner more closely mimicking the contours of the human body. By designing depth into the garment as opposed to simply providing enough material for the garment to drape around the user, load is once again distributed and pinch points concentrating loads in the garment are avoided. In embodiments, cells containing weights 12 can be arranged on side panels to further distribute weights 12 around a user's body. Various other portions of a vest disclosed herein can have a paneled assembly for the same reasons. For example, the shoulders can comprise panels constructed specifically for sizing, or panels can be defined within a unitary portion of material, to deliberately follow the depth of the human body as opposed to simply allowing the material's drape to contour to the user's body as would happen with a garment designed "flat."

Due to the stress attendant wear and use of a weighted garment, ruggedizing various portions of augmented gear 10 improves longevity and durability. For example, armholes of a vest depicted herein can include a single turned binding with, e.g., a one-half inch finish, providing not only aesthetic benefits but increased ruggedness. In alternative embodiments, a double turned binding or alternative binding could be used. In another example, various hemming and seam reinforcement can be added. In further examples, multiple plies can be used in areas that frequently move or pull (e.g., collar, shoulder).

This combination of weight, insulation, and compression provides the user with synergistic performance improvements greater than the sum of their parts. Prior art devices that focus on any one of these components individually give an expected outcome. Weight vests in the prior art individually provide resistance; insulated materials in different prior art increase core temperature and heat; and compression devices in still other prior art can support core strength. However, the prior art does not combine, and prior artists did not identify the synergistic effects of combining weight, heat insulation, and compression. Bearing increased weight combined with compression and/or insulation causes the user's body to respond significantly more to than if it is just trying to respond to one of these stimuli.

A user's body wearing the augmented gear 10 expends effort trying to regulate its core temperature, which requires an increase in blood flow for heat regulation. This increase in cardiovascular workload also increases the accompanying detoxification that is inherent in increased blood flow. This occurs while the user is carrying extra weight which requires the user to engage corresponding muscular systems to accommodate the increased weight. At the same time having the torso compressed makes it harder for the user to breath, thereby forcing the user's core to engage. Compression also aids in spreading the persistent load of the weight over a larger area by hugging the user's body and creating friction to motion, reducing stress on parts of the body that weight vests typically rest exclusively on such as the shoulders. In embodiments, the unexpected result of combining these elements into a single piece of augmented gear 10 gives outputs of, e.g., 15-25% increase in performance.

The weights 12 incorporated into the augmented gear 10 are selected to be sufficiently heavy to be at least noticeable to the user but not so heavy as to be cumbersome and interfere with the user's activity. If the augmented gear 10 is too heavy, it will have a negative impact on the user's posture as their body will struggle to compensate for the additional weight. It has been found that selecting weights 12 in the range of between about 2% and about 6% of the user's body weight to be an effective range of weights with a weight range, in embodiments, of about 3% to about 5% of the user's body weight. It is understood that a user's body weight changes over time, so an approximate weight range is sufficient so long as the weight range is such that the user feels the weight bearing on them while using the augmented gear 10 without interfering with the user's range of movement. In various embodiments, augmented gear 10 can be customized to a specific user to provide appropriate weight (and, in embodiments, dimensions for sizing or compressive effect). In alternative embodiments, standard sizing can be provided at various intervals to match common body shapes, sizes, and weights.

To evenly distribute weights 12 in the desired areas of augmented gear 10, augmented gear 10 can include a plurality of cells. Each cell can then contain one or more weights 12. In embodiments, each weight 12 is fixedly positioned within its respective cell to prevent excessive movement or bunching of the weights 12. For example, each weight 12 can be, e.g., sewn around, adhered, or otherwise attached at a specific site or in a specific area within a cell, and in embodiments having cells containing two or more weights 12, the weights 12 within said cell can be arranged at substantially equal distances or within substantially equal-sized areas of the cell. Each cell may define a pocket or cavity configured to receive and fixedly accommodate one or more weights 12 therein.

In embodiments, weights 12 can be round stock of substantially equal sizes and weights. Example materials can include, e.g., steel (including stainless steel), tungsten, brass, iron, copper, or others, including combinations thereof. Non-metal materials can also be used in embodiments. In a particular embodiment, the stock can be, e.g., one half inch diameter per each weight 12 or other suitable dimensions. In a particular embodiment, the stock can be, e.g., one third of an ounce per each weight 12 or any other suitable weight. Using a plurality of spaced-apart weights 12 permits flexibility between each of the weights 12 such that augmented gear 10 can flex or move at virtually any location, reducing restriction on the user. In embodiments where two or more weights 12 are arranged in two or more cells, spacing between cells can provide still further flexibility by including regions where no weights are positioned. In this manner, weight can be evenly distributed throughout augmented gear 10 and about the user without requiring rigid uniform weighting about the entire weighted areas of the garment.

In embodiments, each of weights 12 can be encased in a compressible material or padding, or arranged within a compressible material or padding within a respective cell. This prevents discomfort due to the relative proximity of hard weights to the user, and enhances the longevity and durability of augmented gear 10 by preventing the weight or limited motion of weights 12 from wearing through the structure of the garment. In alternative or complementary embodiments, the material(s) forming the structure of the garment can incorporate such compressible materials or padding. In still further alternative or complementary embodiments, the interior of cells can be lined with a wear-resistant material to prevent damage from unavoidable relative movement of components that occurs as a function of the flexibility of augmented garment 10.

The augmented gear 10 has a front face 16 and a back face 18 that correspond to the front and back of a user. The distribution of the weights 12 on the front face 16 and the back face 18 can be different in different embodiments. In some embodiments, the weights 12 are distributed approximately equally between the front face 16 and the back face 18. Further, weights 12 can be distributed approximately equally, or in equal amount per unit garment area, on the front face 16, back face 18, and side panels. In other embodiments, the weights 12 are distributed approximately equally throughout the augmented gear 10. In some embodiments, the weights 12 are distributed to not interfere with natural expansion and contraction of the user's muscle groups during use. In some embodiments, the weights 12 located on the front face 16 are arranged towards the user's abdomen. In some embodiments, the weights 12 located on the back face 18 are equally distributed around the back face 18. The arrangement of weights 12 on the augmented gear 10 could also be varied in different embodiments to distribute the weights 12 complementary to the user's muscle groups. These embodiments are custom augmented gear 10 for specific users for targeted effect. For example, for women the augmented gear 10 may have no weights 12 at the top of the chest, or the weights 12 may be distributed differently for differently able users.

Figure 10:
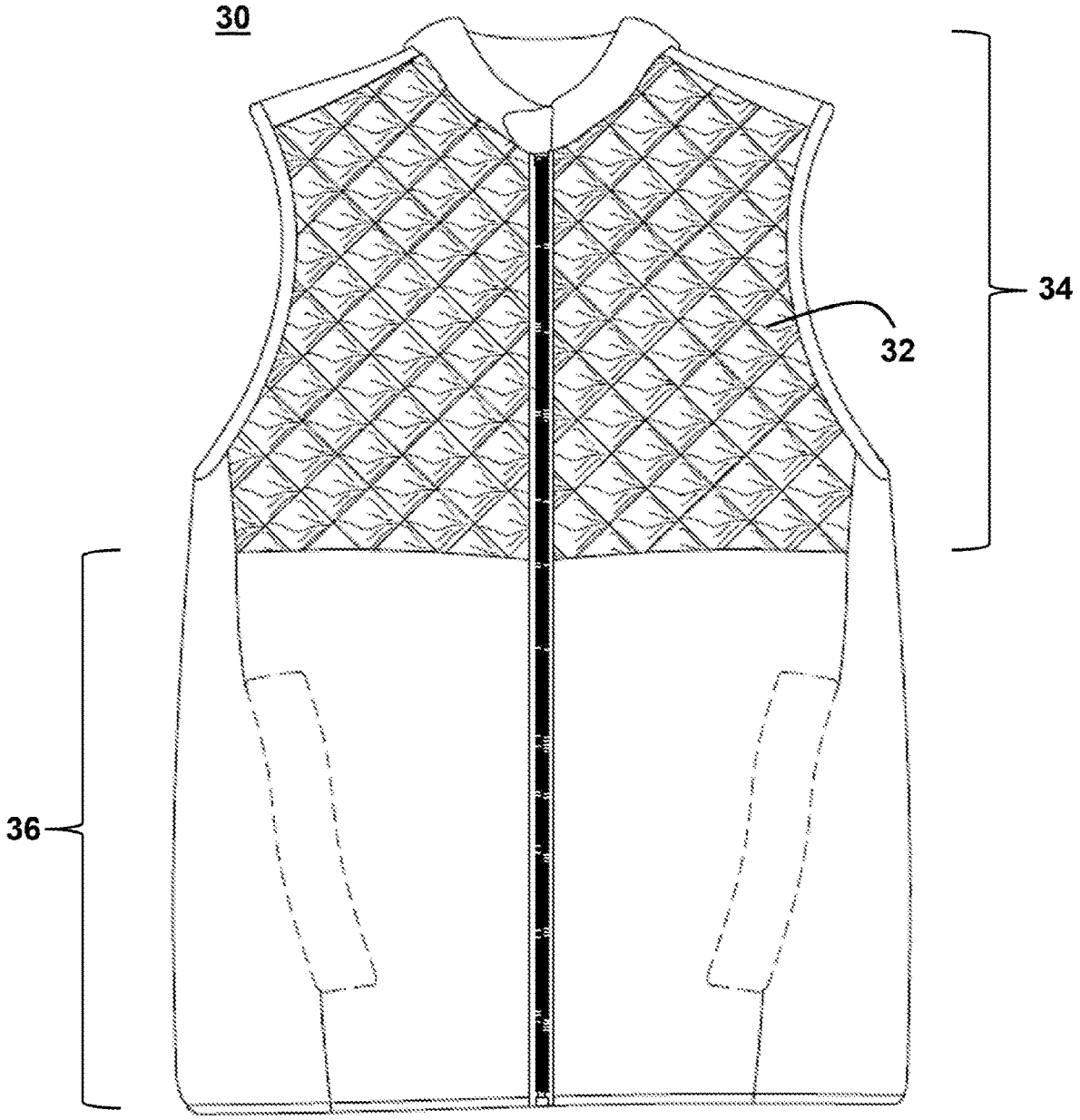
FIG. 10 illustrates a front view of an alternative embodiment of augmented gear disclosed herein.

In some embodiments, the weights 12 may be distributed or arranged such that substantially all of the augmented gear 10 includes weights 12, such as is illustrated in FIGS. 1-3. In other embodiments, the weights 12 may be distributed or arranged such that only one or more specific portions of the augmented gear 10 includes weights 12, such as is illustrated in FIG. 10. By way of non-limiting example, an upper half of the augmented gear 10 may include a plurality of weights 12 distributed thereabout, while a lower half of the augmented gear 10 may be devoid of any such weights 12.

The weights 12 are any high density material that can be incorporated into the augmented gear 10. The weights 12 could include metal, plastics, silicone, resins, or a combination thereof that could be cut up pieces, plates, bars, rods, or other shapes. The weights 12 are installed in the augmented gear in a foam or silicone matrix or could be fit into pockets or sleeves.

While the weights 12 have a compressive effect on the user, the augmented gear 10 further comprises a stretchable material that causes the augmented gear 10 to hold the weights closer to the user's body and further compress against the user's body. The weights 12 located on the user's body and the compression of the augmented gear 10 can be adjusted for the user's body to activate the user's musculature and adjust the user's posture when the augmented gear 10 is in use. The compression of the augmented gear 10 against the user's body is sized to fit tightly against the user but is flexible enough to allow some stretching and flexing and not limit the movement of the user. So, while the user experiences compression from the weights 12 and from the material of the augmented gear 10 bearing against their body, the adaptation of the augmented gear 10 to the user's form also means that there is some additional compression from the normal breathing of the user. Materials like neoprene have been found to be effective for this purpose, but other similar materials would also work. Alternatives can include materials formed of, e.g., one or more of nylon, spandex, silicon, cotton, wool, rubber (including latex or non-latex materials), polyester, and various other materials that have, or can be imparted with, elastic properties, including combinations thereof.

The placement of the weights 12 and the compression of the augmented gear 10 also have the benefit of activating the user's musculature to adjust the user's posture. The combination of weight and compression from the augmented gear 10 creates kinesthetic feedback in the user from wearing the augmented gear 10. This will cause the user to tend to self-correct their posture as they use it. This also provides the user with sensory awareness of their body as they move.

The augmented gear 10 is also manufactured of a material that is insulating to trap a user's heat against their body. This insulation increases the user's perspiration which increases cardiovascular load. The insulation of the augmented gear 10 is therefore also supportive of the thyroid which is used for body thermoregulation. The material can, in embodiments, be a non-breathable material. The neoprene material that is used for compression has also been found to be an effective insulator, but other similar materials would also work. Alternatives can include materials formed of, e.g., one or more of polyester, spandex, nylon, brushed interior fabrics, heat reflective materials, and various proprietary materials used to insulate or retain heat, including combinations thereof.

The augmented gear 10 is a combination of three key components: fractional weight evenly distributed around the body (approximately 2-6% of a person's body weight); compression to hold the weight tight to the user's body to allow engagement of their core, increase breath performance, and keep the weight from pulling on the shoulders or any one area of the body; and, insulation that heats up the body and its ability to sweat. These core components combined provide a significantly greater performance output due to the way each component compounds the other. The performance output attributes are as follows: increased overall body workload, increased circulation and detoxification due to increased cardiovascular output, increased core movement, and improved bone density and muscle development. This offers a significantly greater performance output than any one of weight, compression, and insulation.

FIG. 5A and FIG. 5B illustrate how weights 12 can be arranged in various embodiments. By way of non-limiting example, for the vest portion illustrated in FIG. 5A and FIG. 5B, the portion includes four columns 12*a* of weights 12 and six rows 12*b* of weights 12. In embodiments, some columns may include a different number of individual weights 11 than one or more other columns and/or some rows may include a different number of individual weights 11 than one or more other rows, although other arrangements are possible. In embodiments, individual weights 11 can be separated from one another by stitching or otherwise anchoring the lining between individual weights 11 to assist in sharing the load and to prevent the load from being concentrated on the user's neck or interior of their shoulders and/or to permit flexibility between each of the individual weights 11.

FIG. 6A and FIG. 6B illustrate how weights 12 can be arranged in various embodiments. By way of non-limiting example, for the vest portion illustrated in FIG. 6A and FIG. 6B, the portion includes three columns 12*a* of weights 12 and three rows 12*b* of weights 12. In embodiments, some columns may include the same number of individual weights 11 than one or more other columns and/or some rows may include the same number of individual weights 11 than one or more other rows, although other arrangements are possible. By way of further non-limiting example, the individual weights 11 may be equally spaced apart from one another. In embodiments, individual weights 11 can be inset into the augmented gear 10 (e.g., into the lining thereof).

Figure 7:
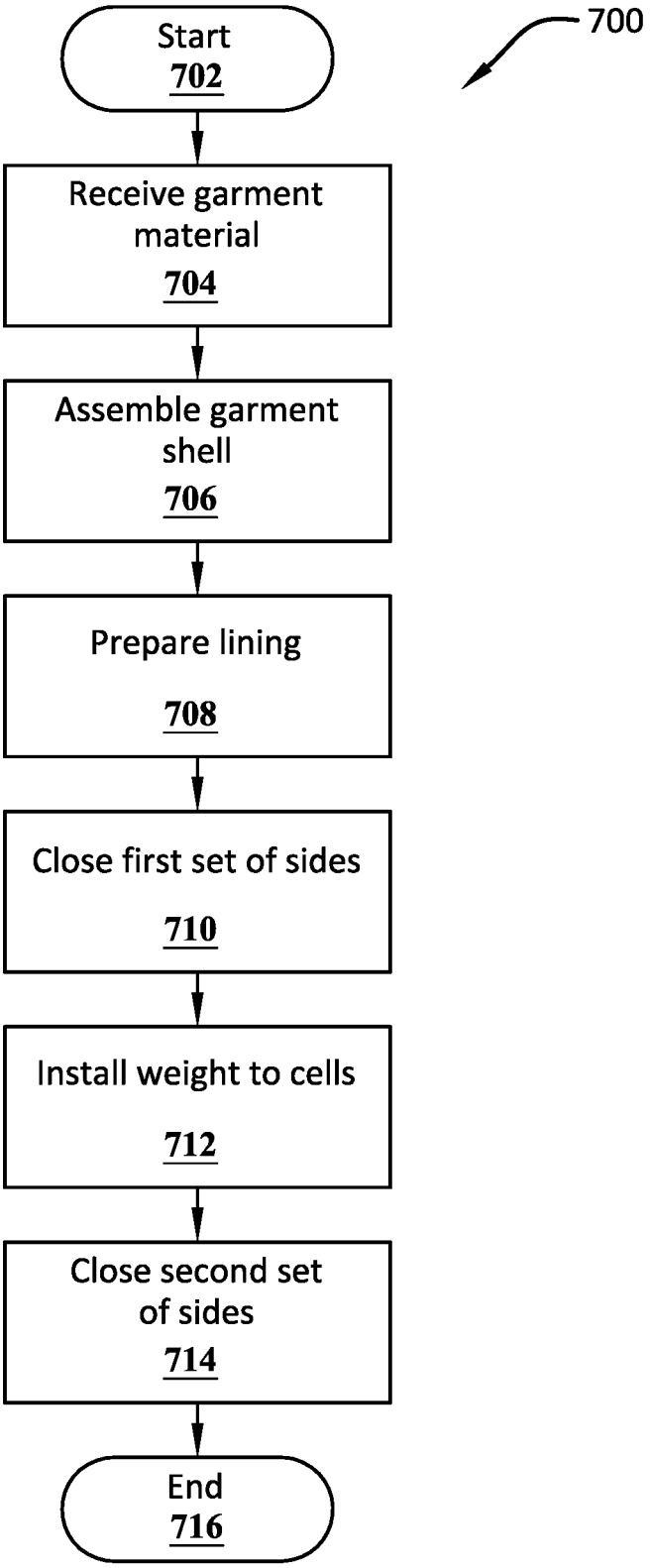
FIG. 7 illustrates a methodology disclosed herein.

FIG. 7 illustrates an example methodology 700 for making augmented gear disclosed herein. Methodology 700 begins at 702 and proceeds to 704 where garment material is received. At 706, using the garment material, the garment shell is assembled. The garment shell can include the various front, back, and side panels.

At 708, one or more linings for the garment can be prepared. These can include interior materials and linings used to contain weights or cells. In embodiments, the lining can be an interior layer similar to the shell material configured to sandwich weights therebetween. In alternative embodiments, the lining can be a different interior material that need not support the weights, which can be sandwiched between layers of garment shell. While lining materials are described as disposed on the inside of the garment, in embodiments, one or more linings can be arranged on the outside of the shell.

At 710, a first set of sides is closed. In embodiments, substantially all of the stitching (or, e.g., adhering, fusing, taping, et cetera), or all of the stitching not required to insert weights, can be completed at 710. In this manner, the load of the weights is not on the material as it is being assembled and closed, allowing for better stitching and straighter edges, and avoiding material stretching.

At 712, weights are installed into the cells and/or linings of the garment. This can include, e.g., inserting and securing individual weights as shown in, e.g., FIG. 5A and FIG. 5B, or materials containing equally spaced weights can be inserted into cells or lining as shown in, e.g., FIG. 6A and FIG. 6B.

At 714, a second set of sides can be closed (e.g., stitched, sealed, et cetera) to complete the vest and secure all of its components. At 716, methodology 700 can end.

In embodiments, multiple linings or layers can be attached in different steps, and as such, methodology 700 can recycle through one or more repetitions of 708, 710, 712, and/or 714.

In alternative or complementary embodiments, a weight pack or pre-assembled cell, sewn shut (e.g., as shown in FIG. 5B) can be attached to one or more linings. When assembling a weight pack or pre-assembled cell, weights can be inserted into the cell or lining portion one row at a time, with row ends left open until each area corresponding to a weight is filled. A seam allowance can be provided at the edge of a weight pack or cell to accommodate stitching or other attachment to a lining and/or shell.

In embodiments, weights loaded into foam can be prepared in a step involving cutting foam pieces to particular sizes and patterns and punching holes for the desired density and even distribution. To ensure durability, buffers can exist between the foam edge as well as other holes. In embodiments, at least one half inch can be provided between the edges of any holes and/or edges. The weight-laden foam can then be wrapped in a fabric that can be, e.g., stitch-able, adhesive, fusible, or have other means of attachment or loading into a garment.

Pre-assembled cells or weight packs can be assembled by inserting them into corresponding cells or "channels" of a shell and/or lining. The weights can be inserted into the "lowest" portion of the garment first (e.g., as worn, the bottom of the vest) and the cell or channel can be closed to secure the weights therein. Shell or lining cells or channels can be filled with weights from bottom to top and closed as loaded.

Figure 8:
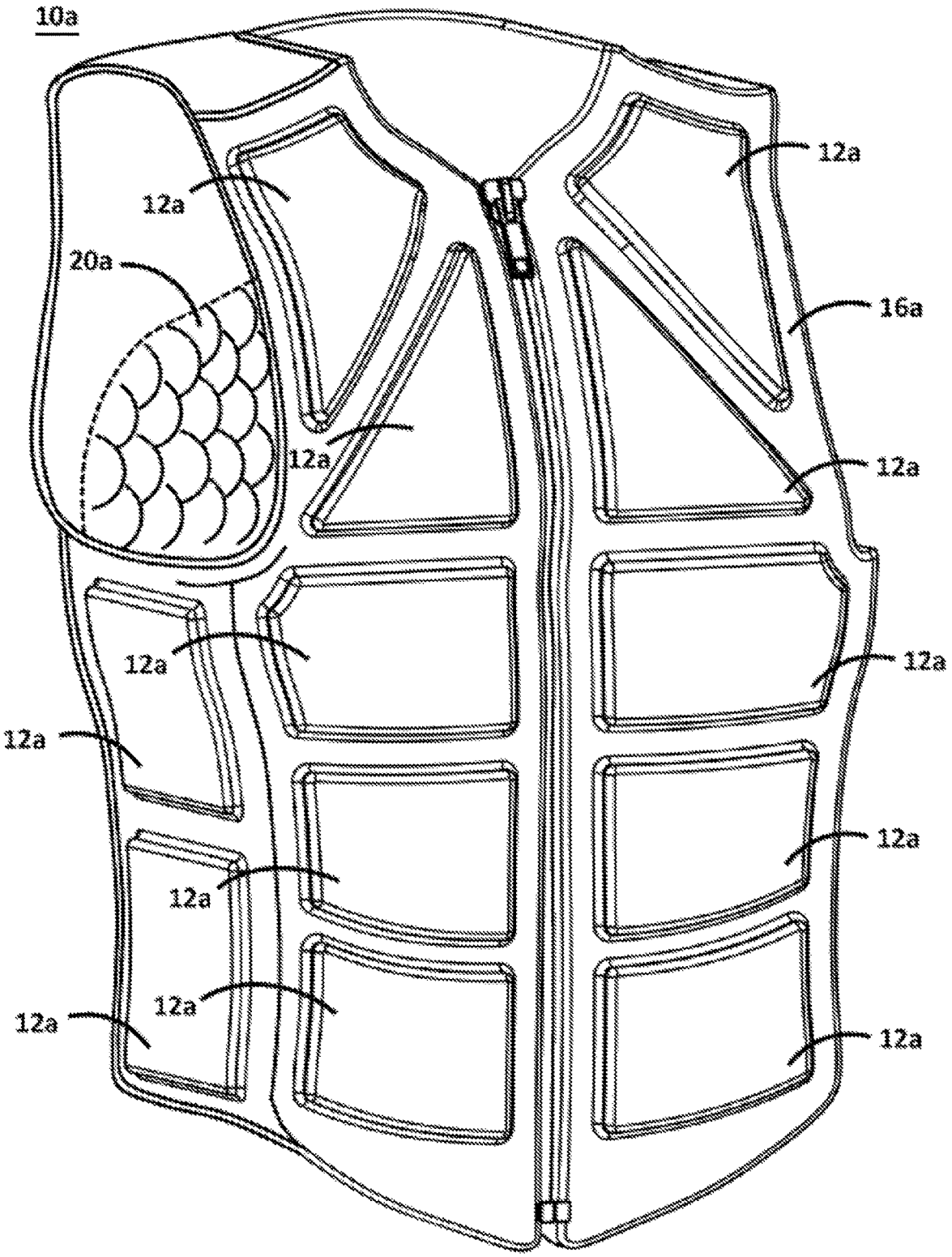
FIG. 8 shows an embodiment of augmented gear that has sleeves.

In some embodiments, augmented gear 10*a* can incorporate nodules 20*a* as shown in FIG. 8. These nodules 20*a* can be buttons, tabs, pins, or raised surface features formed or otherwise integrated into the inner surface of the augmented gear 20*a*. The nodules 20*a* may be located in the augmented gear 10*a* and configured to apply pressure to corresponding muscular release points on the user's body. Nodules 20*a* can be arranged to align with release or trigger points based on a particular person's anatomy (for a custom augmented gear 10*a*) or based on average human anatomy according to various standardized sizes such that the nodules would be arranged at trigger or release points for a person of average proportions for their height and weight.

Figure 9:
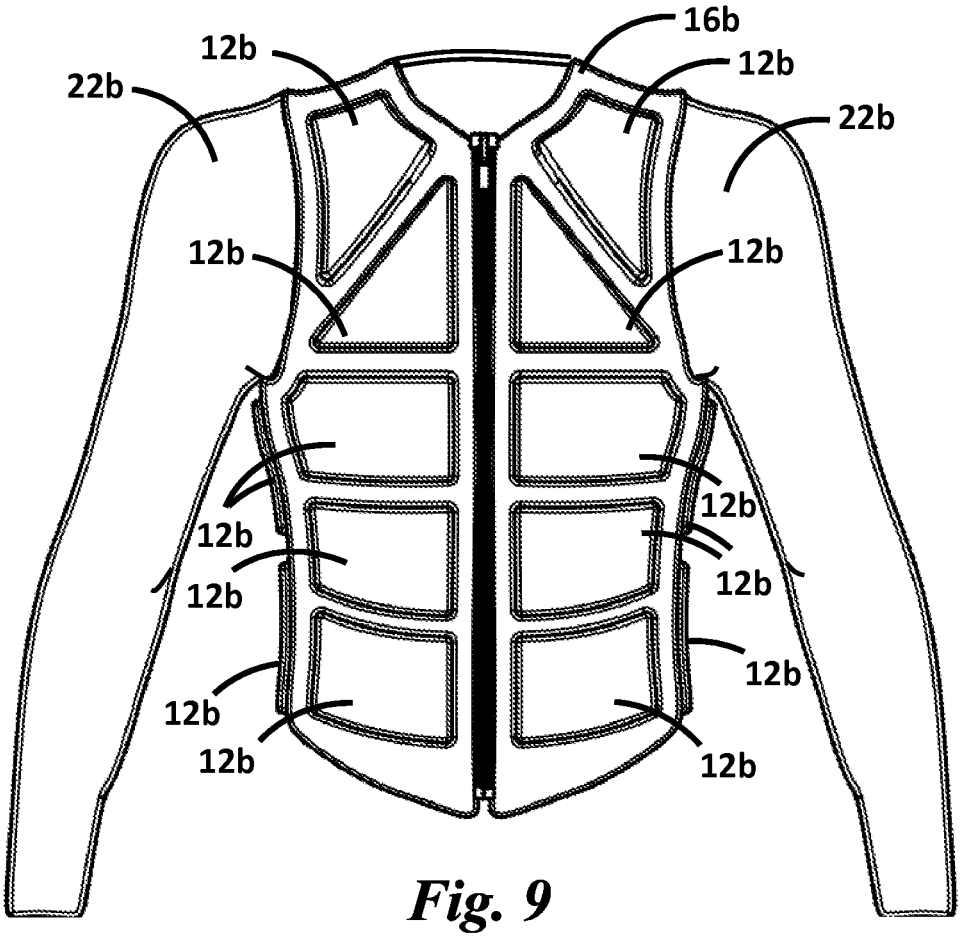
FIG. 9 shows a close up of nodules embedded in an embodiment of augmented gear that cause pressure against a user's muscular release points.

The augmented gear shown herein can be used in a variety of ways, such as for active exercise, for therapy, or for daily use. This means that varieties of augmented gear can be created to include the combination of necessary elements identified above (weight, compression, and insulation). The augmented gear taught herein could be worn over or under a user's clothing. FIGS. 1-4 show embodiments of augmented gear 10*a* that is a sleeveless vest, but FIG. 9 shows an example of the augmented gear 10*b* that has sleeves. These and other alternative configurations could also include the nodules shown in FIG. 8.

FIG. 10 illustrates an alternative embodiment of augmented gear 30 wherein the weights 32 are arranged over only a portion of the garment, such that one portion 34 of the augmented gear 30 has one or more weights 32 arranged therein or thereon and another portion 36 of the augmented gear 30 is devoid of any weights arranged therein or thereon. Specifically, the weights are arranged in individual cells having an ornamental pattern over a top portion of the vest (e.g., a top half of the vest), but do not extend along the lower portion (e.g., a lower half) or sides of the vest. In embodiments, augmented gear 30 may or may not include heat insulating and/or compressive material.

This invention has been described with reference to several embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. Augmented gear for a user, comprising:

a garment formed at least in part of an insulating material configured to trap the user's body heat under the insulating material, the garment defined by at least a front bodice, an opposite back bodice, a panel extending between and interconnecting the front bodice and the back bodice, and an inner surface comprising a plurality of nodules integrated therein and configured to apply pressure to corresponding muscular release points on the user's body; and a plurality of weights integrated into the garment, wherein the plurality of weights are distributed equally throughout weight-bearing portions of the garment, each of the front bodice, the back bodice, and the panel comprising at least one of the plurality of weights such that the garment is configured to compress against the user's body in at least three dimensions inwardly from the front bodice, the back bodice, and the panel.

2. The augmented gear of claim 1, wherein the panel comprises a pair of panels selected from the group consisting of side panels and shoulder panels, each panel of the pair of panels comprising at least one of the plurality of weights.

3. The augmented gear of claim 1, wherein the panel comprises at least one side panel and at least one shoulder panel, each of the at least one side panel and the at least one shoulder panel comprising at least one of the plurality of weights such that the garment is configured to compress against the user's body in at least four dimensions inwardly from the front bodice, the back bodice, the at least one side panel, and the at least one shoulder panel.

4. The augmented gear of claim 1, further comprising:

a plurality of cells formed within the garment and configured to accept the plurality of weights, wherein each of the plurality of cells is configured to enclose and fixedly position a respective one or more of the plurality of weights therein.

5. The augmented gear of claim 1, wherein the plurality of weights are a plurality of round, flat slugs.

6. The augmented gear of claim 1, wherein each of the plurality of weights is surrounded by a padding material.

7. The augmented gear of claim 6, wherein the padding material is a portion of the garment.

8. The augmented gear of claim 6, wherein the padding material is formed separately from the garment.

9. The augmented gear of claim 1, wherein the augmented gear has a front face and a back face that respectively correspond to the front and back of a user, said plurality of weights are distributed on said front face and said back face, said plurality of weights distributed on said front face are favored towards the user's abdomen, and said plurality of weights distributed on said back face are equally distributed about said back face.

10. The augmented gear of claim 1, wherein said plurality of weights are configured to cause the augmented gear to compress against the user's body.

11. The augmented gear of claim 1, wherein said plurality of weights are installed in the augmented gear in a foam or silicone matrix.

12. A method of manufacturing augmented gear, the method comprising:

assembling a garment shell using a garment material by forming at least a front bodice, an opposite back bodice a panel extending between and interconnecting the front bodice and the back bodice, and an inner surface comprising a plurality of nodules integrated therein and configured to apply pressure to corresponding muscular release points on the user's body;

preparing a lining for the garment shell;

closing a first set of sides of at least one of the shell and the lining, wherein the at least one of the shell and the lining is configured to receive a plurality of weights;

installing one or more weights into the lining; and closing a second set of sides of the at least one of the shell and the lining, wherein closing the second set of sides encloses the one or more weights, each of the front bodice, the back bodice, and the panel comprising at least one of the plurality of weights such that the garment is configured to compress against the user's body in at least three dimensions inwardly from the front bodice, the back bodice, and the panel.

13. The method of claim 12, wherein assembling the garment shell further includes forming the panel at least one side panel and at least one shoulder panel, each of the at least one side panel and the at least one shoulder panel comprising at least one of the plurality of weights such that the garment is configured to compress against the user's body in at least four dimensions inwardly from the front bodice, the back bodice, the at least one side panel and the at least one shoulder panel.

14. The method of claim 12, wherein the lining is an interior layer for the garment shell and configured to sandwich the one or more weights therebetween.

15. The method of claim 12, wherein the lining is sandwiched between a first layer and a second layer of the garment shell.

16. The method of claim 12, wherein closing the second set of sides forms a plurality of cells, each of the plurality of cells configured to enclose and fixedly position a respective one of the plurality of weights therein, the method further comprising:

anchoring the lining between a first set of the plurality of weights and a second set of the plurality of weights, such that the first set of the plurality of weights is separated from the second set of the plurality of weights, the first set of the plurality of weights is enclosed and fixedly positioned by a respective first one of the plurality of cells, and the second set of the plurality of weights is enclosed and fixedly positioned by a respective second one of the plurality of cells.

17. The method of claim 12, further comprising determining a body weight of a user of the augmented gear, wherein a total weight of said plurality of weights is between about 2% and about 6% of the body weight of the user.

18. The method of claim 12, wherein assembling the garment shell includes forming at least a front face and a back face that respectively correspond to the front and back of a user of the augmented gear and installing the plurality of weights into the lining includes distributing the plurality of weights so as to not interfere with natural expansion and contraction of muscle groups of the front of the user and muscle groups of the back of the user during use.

19. The method of claim 12, wherein assembling the garment shell includes forming at least a front face and a back face that respectively correspond to the front and back of a user of the augmented gear and installing the plurality of weights into the lining includes distributing the plurality of weights complementary to muscle groups of the front of the user and muscle groups of the back of the user.

20. The method of claim 12, further comprising adjusting at least one of a location of said plurality of weights on a user's body and a compression of the augmented gear against the user's body to activate the user's musculature and adjust the user's posture when the augmented gear is in use.

* * * * *